US007681605B2

(12) United States Patent
Emes et al.

(10) Patent No.: US 7,681,605 B2
(45) Date of Patent: Mar. 23, 2010

(54) VENDING MACHINE FOR DISPENSING POTABLE LIQUID

(75) Inventors: George Kevin Emes, Prince Rupert (CA); Jeffrey Douglas Kennedy, Victoria (CA); Colin Huw Bradley, Victoria (CA); Emmet Gamroth, Victoria (CA)

(73) Assignee: University of Victoria Innovation and Development Corporation, Victoria, B.C. (CA)

( * ) Notice: Subject to any disclaimer, the term of this patent is extended or adjusted under 35 U.S.C. 154(b) by 915 days.

(21) Appl. No.: 10/576,557

(22) PCT Filed: Apr. 26, 2005

(86) PCT No.: PCT/CA2005/000637

§ 371 (c)(1),
(2), (4) Date: Apr. 18, 2006

(87) PCT Pub. No.: WO2005/104048

PCT Pub. Date: Nov. 3, 2005

(65) Prior Publication Data

US 2007/0125795 A1 Jun. 7, 2007

Related U.S. Application Data

(60) Provisional application No. 60/565,718, filed on Apr. 26, 2004.

(51) Int. Cl.
*B65B 1/04* (2006.01)

(52) U.S. Cl. ..... 141/105; 141/94; 141/100; 141/198

(58) Field of Classification Search ..... 141/94, 141/100–105, 192, 198, 360–362; 222/23, 222/160, 166, 173
See application file for complete search history.

(56) References Cited

U.S. PATENT DOCUMENTS

| | | | | |
|---|---|---|---|---|
| 4,226,267 | A | | 10/1980 | Meacham |
| 5,222,531 | A | | 6/1993 | Baker et al. |
| 5,341,957 | A | * | 8/1994 | Sizemore ..... 222/2 |
| 5,409,094 | A | | 4/1995 | Muraco |
| 5,540,355 | A | * | 7/1996 | Hancock et al. ..... 222/56 |
| 6,126,983 | A | * | 10/2000 | Miller ..... 426/565 |
| 6,578,763 | B1 | | 6/2003 | Brown |
| 6,442,960 | B1 | | 9/2003 | Fournier et al. |

* cited by examiner

*Primary Examiner*—Timothy L Maust
(74) *Attorney, Agent, or Firm*—Klarquist Sparkman LLP

(57) ABSTRACT

A currency-operated liquid dispensing machine includes removable and replaceable containers such as carboys or bags that can be drained sequentially or in parallel. The containers are coupled to a furcated passage having an outlet. Such a vending machine dispenses metered quantities of water in response to an amount paid.

26 Claims, 4 Drawing Sheets

VENDING MACHINE FOR DISPENSING POTABLE LIQUID

CROSS-REFERENCE TO RELATED APPLICATIONS

This application is the National Stage of International Application No. PCT/CA2005/000637, filed Apr. 26, 2005, which claims the benefit of U.S. Provisional Application No. 60/565,718, filed Apr. 26, 2004.

FIELD OF THE INVENTION

The present invention relates to a currency-operated liquid dispensing machine for liquid retained in a plurality of removable and replaceable containers such as carboys. More specifically, it is for a vending machine for dispensing water from carboys.

BACKGROUND OF THE INVENTION

Vending machines have been used for many years for dispensing a variety of goods, ranging from clothing, to beverages, to food. Beverages may be dispensed in bottles, cans or into a cup or other suitable container.

In recent years, bottled water has been made available in vending machines. The increase in water purchases results from concerns that consumers have about the quality of tap water. Additionally, consumers find it convenient to carry water in bottles rather than looking for a source of water. There are, however, problems associated with the sale of bottles of water that are sized for individual usage. According to some records, 1.5 million tons of plastic are used to bottle water every year. These bottles have to be recycled or disposed of, both of which lead to pollution.

As an alternative to bottled water, many businesses provide water coolers or water dispensers. As disclosed in U.S. Pat. No. 5,409,094 these may be coin-operated. Water dispensers usually provide both chilled and ambient temperature water from a five gallon carboy. The carboy is inverted into a reservoir, which is usually gravity fed. This means that for water to be released from the reservoir and carboy, air must replace the water. Accordingly, water dispensers of this type generally have an open reservoir to allow air exchange. Concern over the safety of these water dispensers has resulted in the development of closed system dispensers as disclosed in U.S. Pat. No. 5,222,531 and U.S. Pat. No. 6,442,960. While this overcomes the concern over cleanliness, the problem of a limited supply of water remains, as these are designed to deliver water from a five gallon carboy. Accordingly, they are not well suited for commercial sales of water.

Another approach to providing clean drinking water is to provide a reverse osmosis machine. These are attached to a water supply, most typically, a municipal water system, hence the constraint of limited water supply is overcome. The water passes through a series of filters in addition to undergoing reverse osmosis. Unfortunately, there have been many problems associated with the cleanliness of the filters, pipes and storage tanks for these machines. Despite these problems, reverse osmosis machines have been installed in, for example, shopping centres where they are coin operated.

It is an object of the invention to overcome the deficiencies in the prior art.

SUMMARY OF THE INVENTION

It is an object of the invention to provide a vending machine that delivers measured quantities of liquid from a plurality of containers such as carboys in response to input of a selected value of currency. The vending machine is comprised of a cabinet in which the carboys are housed. The carboys are releasably housed on holders. The vending machine may be coin-operated or may be operated by an alternative currency source, such as a credit card. The quantity of liquid dispensed is determined by the amount paid. A controller and a monitor are provided to control and measure the quantity of liquid dispensed.

The liquid is gravity-fed or pumped from a plurality of carboys, which are arranged in series, with one emptying, then the second emptying and so on, until all the carboys have been drained or in parallel, with all the carboys draining at the same rate, or if preferred, sequentially, under the control of a solenoid valve. A furcated passage having a branch draining each carboy carries the liquid from the carboy to an outlet. In order to permit the release of liquid, there is provided an air exchange means.

In one aspect of the invention there is provided a currency operated liquid dispensing machine for liquid retained in a plurality of removable and replaceable containers such as carboys or bags. The liquid dispensing machine comprises a cabinet, a suitably selected holder housed in the cabinet, for releasably retaining the plurality of containers, a furcated passage, a plurality of terminally located liquid dispensing systems, a controller, a dispensing valve, and a currency acceptor and processor.

The furcated passage comprises a main passage, an open end to define an outlet and a plurality of branches, each terminating in an inlet. The furcated passage is to permit fluid communication between the plurality of containers and the outlet. The outlet is in communication with the ambient atmosphere, and is located to permit feeding of the liquid from the containers to the outlet. The plurality of terminally located liquid dispensing systems is for releasably coupling the inlet to a container to permit the flow of liquid. The controller is to determine the flow of liquid through the furcated passage. A dispensing valve is to stop and start the flow of liquid. The controller is also in communication with the dispensing valve to selectively actuate the dispensing valve. A currency acceptor and processor is for communication with the controller. This allows the liquid to be dispensed from the currency operated liquid dispensing machine in a metered volume in response to input of a selected value of currency.

In one aspect of the invention, a currency operated liquid dispensing machine for liquid retained in a plurality of removable and replaceable containers such as carboys or bags is provided. The liquid dispensing machine comprises;

a cabinet;

a suitably selected holder housed in the cabinet, for releasably retaining the plurality of containers;

a furcated passage comprising a main passage, an open end to define an outlet and a plurality of branches, each terminating in an inlet, the furcated passage to permit fluid communication between the plurality of containers and the outlet, the outlet being in communication with the ambient atmosphere, the outlet located to permit feeding of the liquid from the containers to the outlet, a plurality of terminally located liquid dispensing systems for releasably coupling the inlet to a container to permit the flow of liquid;

a monitor to determine the flow of liquid through the furcated passage;

a dispensing valve to stop and start the flow of liquid;

a controller in communication with the monitor to selectively actuate the dispensing valve; and a currency acceptor and processor for communication with the controller, wherein liquid is dispensed from the currency operated liquid dispensing machine in a metered volume in response to input of a selected value of currency.

In another aspect the invention further comprises a pump to urge the liquid from the containers to the outlet.

In another aspect of the invention each branch has a solenoid valve in communication with the controller to control the flow of liquid.

In another aspect of the invention the main branch comprises a manifold.

In another aspect the invention further comprises a gas exchanger for gaseous exchange between the ambient atmosphere and the containers.

In another aspect of the invention the gas exchanger comprises a filter unit.

In another aspect of the invention the liquid dispensing system comprises a penetrater and a coupler.

In another aspect of the invention the controller comprises a flow monitor.

In another aspect of the invention the flow monitor is located in line with the main passage.

In another aspect of the invention the flow monitor is integral with the pump.

In another aspect of the invention the flow monitor is located in parallel to the main passage.

In another aspect of the invention the controller comprises a timer.

In another aspect of the invention the controller is in electronic communication with the monitor.

In another aspect of the invention the currency acceptor and processor is in electrical communication with the controller.

In another aspect the invention further comprises a surge buffer, the surge buffer located to dampen surging of the liquid from the outlet.

In another aspect of the invention the dispensing valve is a check valve.

In another aspect of the invention the holder comprises an at least one rack for releasably retaining the containers.

In another aspect the invention further comprises a collar for receiving each container, the collar being releasably housed on the holder.

In another aspect of the invention the cabinet is refrigerated.

In another aspect the invention further comprises a counterbalance.

In another aspect the invention further comprises a water presence sensor.

In another aspect the invention further comprises an alarm system to indicate when the dispensing machine is empty.

In another aspect of the invention the rack is a shelf that is rotatably mounted to the cabinet to permit swinging of the shelf.

In another aspect of the invention the pump is a peristaltic pump.

In another aspect the invention further comprises a bottle presence sensor.

In another aspect of the invention the branches of the furcated passage are in series, such that in use, one container is substantially drained before the next container begins to drain.

In another aspect of the invention the outlet is located to permit gravity feeding of the liquid from the containers to the outlet.

DETAILED DESCRIPTION OF THE INVENTION

Figure 1:
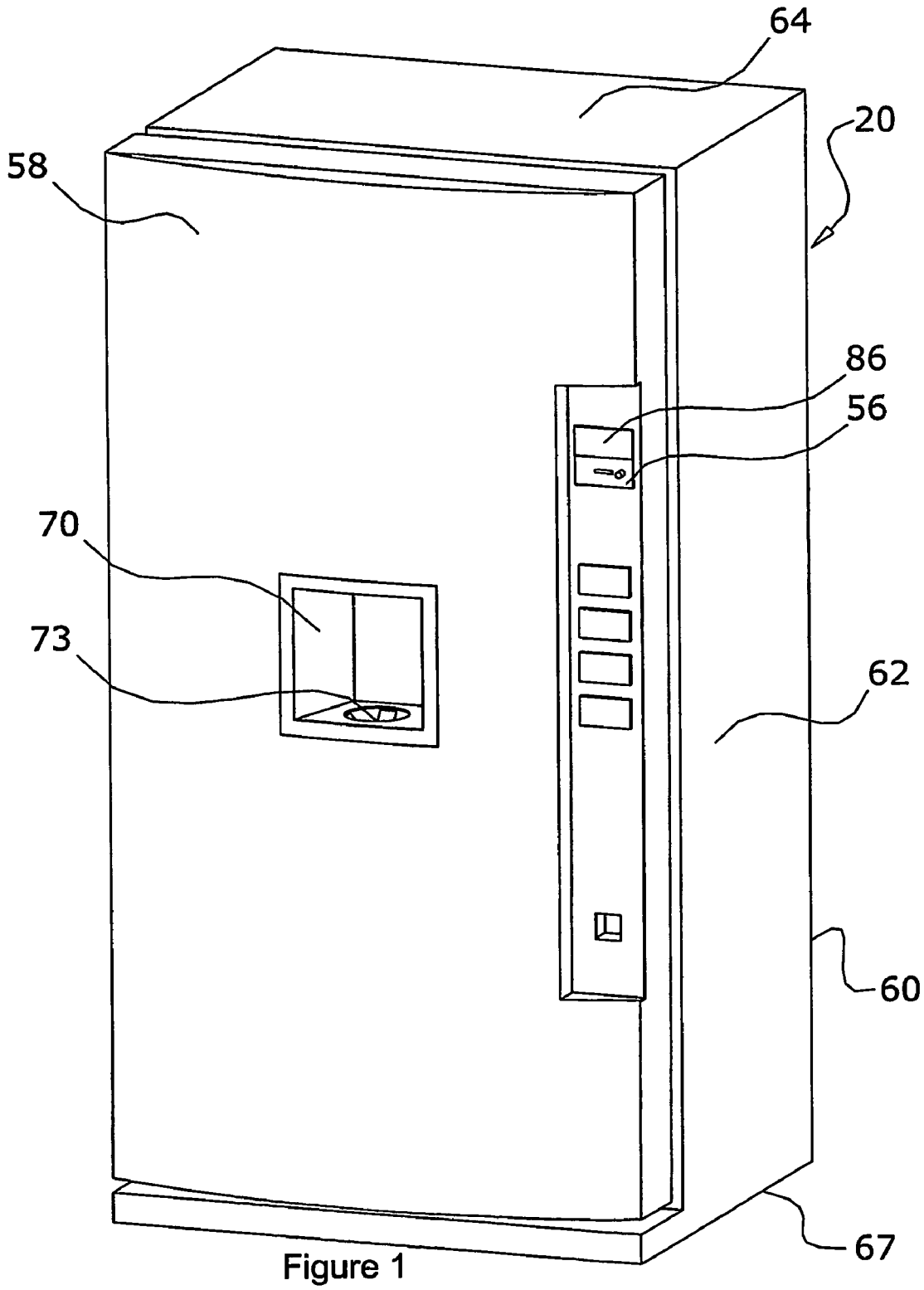
FIG. 1 An orthogonal view of a vending machine for dispensing bottled water in accordance with the present invention.
Figure 2:
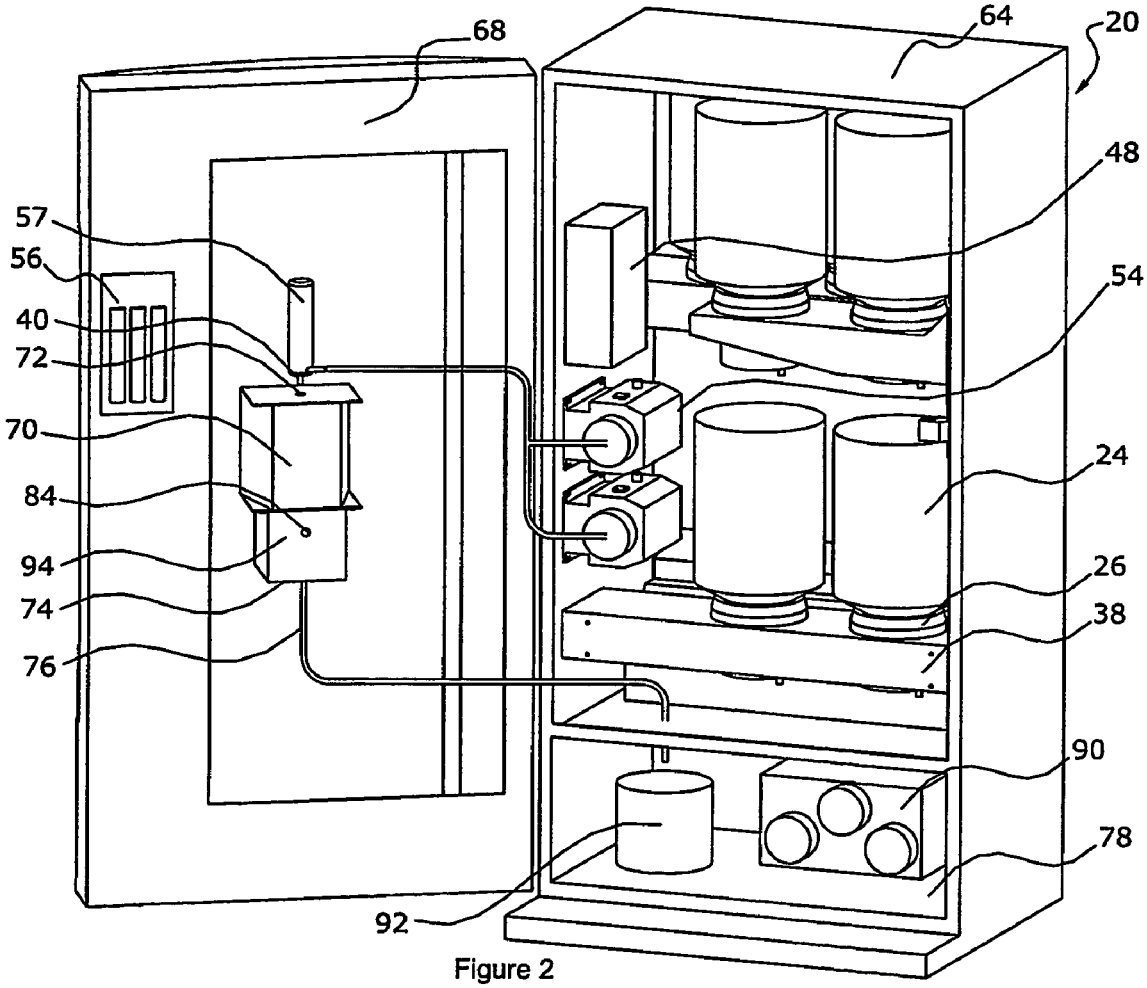
FIG. 2 An orthogonal view of the vending machine of FIG. 1 with the door opened.
Figure 3:
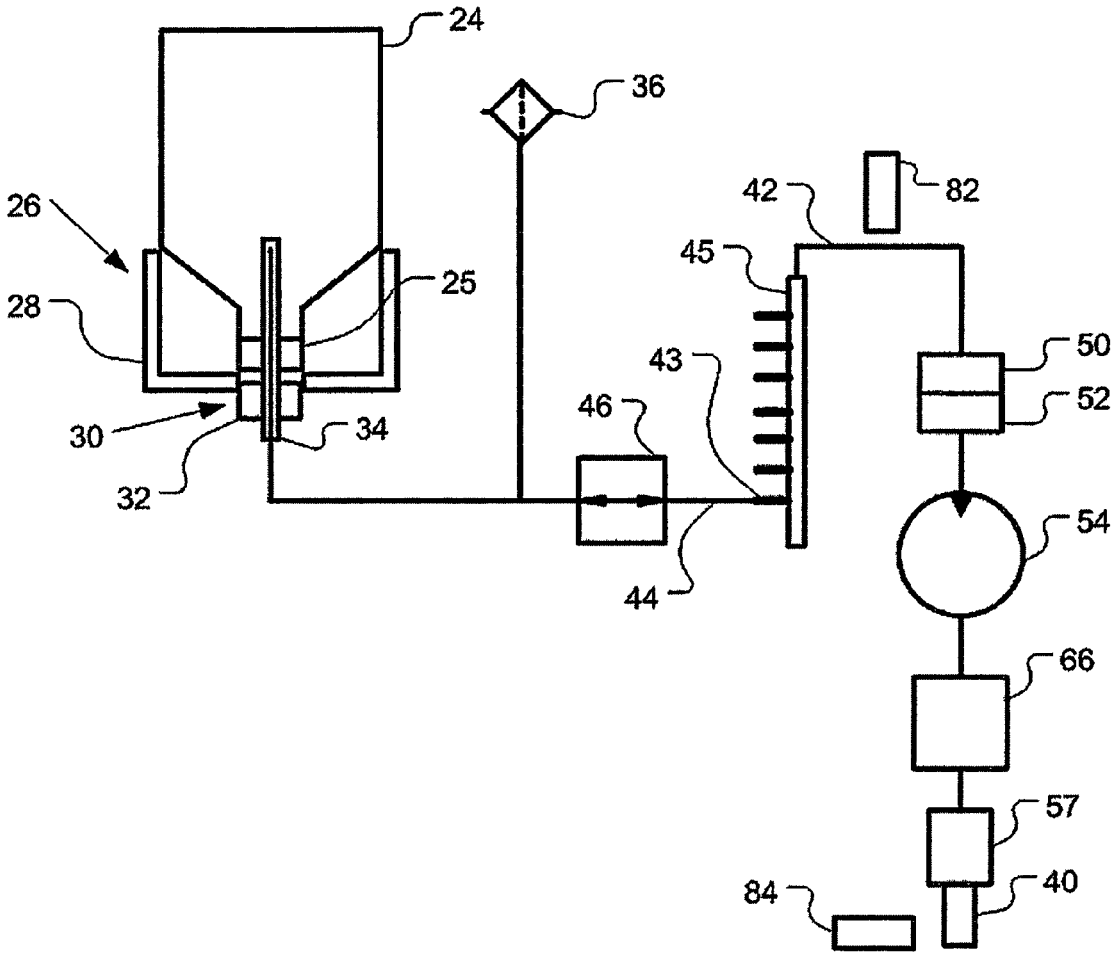
FIG. 3 A schematic of a single water line from a carboy to the outlet in accordance with the present invention.

A vending machine, as shown in FIGS. 1 and 2, generally indicated as 20 has a cabinet 22 in which a plurality of carboys 24 are housed for dispensing a measured quantity of water. Each carboy is removably mounted in an inverted manner on a holder 26. As shown in the schematic of FIG. 3, the holder 26 is comprised of a water container support 28 and a hygienic water dispensing system 30 having a mounting adapter 32, a diaphragm/feed tube 34, and an air filter 36 provided with a filter element, as disclosed in U.S. Pat. No. 5,222,531, hereby incorporated by reference. The feed tube 34 is sufficiently resilient to pierce a carboy cap 25, and therefore functions as both a penetrator and a coupler.

Figure 4:
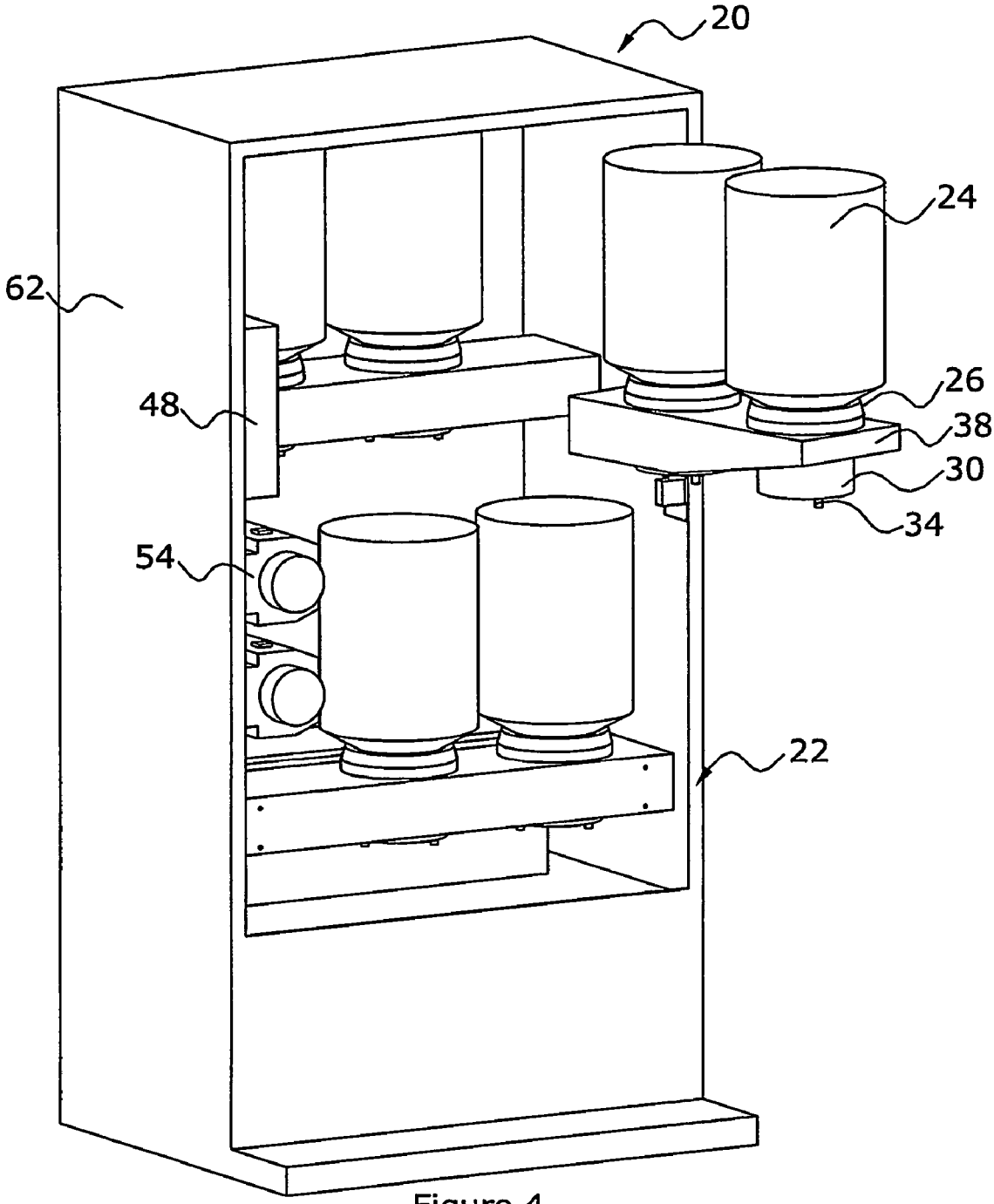
FIG. 4 An orthogonal view of the vending machine of FIG. 1 with the door removed and the rack swung open.

As shown in FIG. 2, the holder 26 for supporting the carboy 24 is mounted on a rack 38. As shown in FIG. 4, the racks 38 swing in and out to assist in the loading and unloading of the carboys 24.

As shown in FIG. 3, the carboys 24 are arranged in parallel and are in fluid communication with an outlet 40 by means of a furcated passage 42, each branch 44 of the furcated passage 42 being fed by a single carboy 24 through an inlet 43. On each branch 44 is a solenoid valve 46, the solenoid valve 46 being in communication with a controller 48 to control the flow of water. The main passage of the furcated passage 42 is a manifold 45 located downstream from the solenoid valves 46. It functions to collect water from the various carboys 24. The controller operates to control a flow meter 50 located in-line between the outlet 40 and the branches 44 of the furcated passage 42. In an alternate embodiment, the controller 48 has a timer 52 to determine the flow of water. The controller 48 is in communication with a peristaltic pump 54 that pumps the water and controls the amount of time that the pump turns at a specific rate. In the embodiment that relies on gravity to feed water through the system, the pump 54 is absent, and the controller 48 is in communication with a dispensing valve, which can be a check valve 66 to control the flow of water. The controller 48 is also in communication and under the control of a coin-operated dispenser 56 as described in U.S. Pat. No. 5,409,094, hereby incorporated by reference.

A check valve 66 acts as a sealing mechanism and opens when the pump operates and closes when the pump stops to stop and start the flow of water. A surge buffer 57 reduces surging of water from the peristaltic pump 54. The outlet 40 is configured as a nozzle to dispense water in a smooth laminar flow.

The cabinet 22 is equipped with a refrigeration unit 90 for chilling the water. The cabinet 22 is generally rectangular with a front 58, a back 60, two sides 62, a top 64 and a bottom 67. The front 58 is essentially comprised of a door 68 for accessing the carboys 24. A recess 70 in the cabinet 22 has an aperture 72 to accept the outlet 40, as shown in FIG. 2. There is a second aperture 73 in the base of the recess to receive the bottle to be filled. Beneath the recess and the aperture is a bottle centering mechanism 94 that acts to position bottles of various sizes to be concentric with the outlet for filling. A drip tray 74 forms the lower surface of the centering mechanism 94 and is in fluid communication with an overflow tube 76. The overflow tube 76 preferably is fed into a drain or a drip pan 92.

The cabinet 22 is equipped with a counterbalance 78 that is proximal to the bottom 67 of the cabinet to assist in counterbalancing the weight of the carboys 24.

Two sensors, a water present sensor 82 and a bottle present sensor 84 communicate with the controller 48. The water present sensor 82 is located directly after the manifold 45. The bottle present sensor 84 is located in the bottle centering mechanism 94 and is an optical sensor. Additionally, the dispensing machine may be equipped with an alarm 86 to indicate when the dispensing machine is empty.

The foregoing description of a vending machine for dispensing potable liquid describes the preferred embodiment and is not meant to be limiting. As would be apparent to one skilled in the art, there can be, for example, variations in the feed tube, variations in the currency acceptor and processor, and variations in the cabinet. Further variations may relate to the containers available to retain the liquid, for example, if the liquid is delivered into the system from a bag, a suitably selected accepting means to releasably retain a bag would be provided while there would be little need for a gas exchange system. Other variations include a number pad for entering a custom amount of liquid, and a touch screen rather than a keypad. The bottle present sensor may be a capacitive sensor, a force sensor or a limit switch, for example, but not to be limiting. The racks may be removable, they may be replaced with a rail that the holders can move along, and they may be configured to accept a range of number of containers, depending upon the size and weight of the containers, for example, but not to be limiting.

We claim:

1. A currency operated liquid dispensing machine for liquid retained in a plurality of removable and replaceable containers, said liquid dispensing machine comprising;

a cabinet;

a suitably selected holder housed in the cabinet, for releasably retaining the plurality of containers;

a furcated passage comprising a main passage, an open end to define an outlet and a plurality of branches, each terminating in an inlet, said furcated passage to permit fluid communication between the plurality of containers and said outlet;

said outlet being in communication with the ambient atmosphere, said outlet located to permit feeding of the liquid from the containers to said outlet;

a plurality of terminally located liquid dispensing systems for releasably coupling said inlet to a container to permit the flow of liquid;

a dispensing valve to stop and start the flow of liquid;

a controller to determine the flow of liquid through said furcated passage and to selectively actuate said dispensing valve;

a currency acceptor and processor for communication with said controller, wherein liquid is dispensed from said currency operated liquid dispensing machine in a metered volume in response to input of a selected value of currency; and a surge buffer, said surge buffer located to dampen surging of the liquid from said outlet.

2. The dispensing machine of claim 1, wherein said dispensing valve is a check valve.

3. The dispensing machine of claim 1, wherein the holder comprises an at least one rack for releasably retaining the containers.

4. The dispensing machine of claim 3, further comprising a collar for receiving each container, said collar being releasably housed on said holder.

5. The dispensing machine of claim 1, wherein said cabinet is refrigerated.

6. The dispensing machine of claim 1, further comprising a counterbalance.

7. The dispensing machine of claim 1, further comprising a water presence sensor.

8. The dispensing machine of claim 7, further comprising an alarm system to indicate when said dispensing machine is empty.

9. The dispensing machine of claim 3, wherein said rack is a shelf that is rotatably mounted to said cabinet to permit swinging of said shelf.

10. The dispensing machine of claim 1, wherein said pump is a peristaltic pump.

11. The dispensing machine of claim 1, further comprising a bottle presence sensor.

12. The dispensing machine of claim 1, wherein said outlet is located to permit gravity feeding of the liquid from the containers to said outlet.

13. The dispensing machine of claim 1, further comprising a pump to urge the liquid from the containers to the outlet.

14. The dispensing machine of claim 1, wherein each branch has a solenoid valve in communication with said controller to control the flow of liquid.

15. The dispensing machine of claim 1, wherein said main passage comprises a manifold.

16. The dispensing machine of claim 1, further comprising a gas exchanger for gaseous exchange between the ambient atmosphere and the containers.

17. The dispensing machine of claim 16, wherein said gas exchanger comprises a filter unit.

18. The dispensing machine of claim 1, wherein said liquid dispensing system comprises a penetrater and a coupler.

19. The dispensing machine of claim 1, wherein said controller is comprised of a flow monitor.

20. The dispensing machine of claim 19, wherein said flow monitor is located in line with said main passage.

21. The dispensing machine of claim 20, wherein said flow monitor is integral with said pump.

22. The dispensing machine of claim 20, wherein said flow monitor is located in parallel to said main passage.

23. The dispensing machine of claim 1, wherein said controller comprises a timer.

24. The dispensing machine of claim 21, wherein said controller is in electronic communication with said monitor.

25. The dispensing machine of claim 1, wherein said currency acceptor and processor is in electrical communication with said controller.

26. A currency operated liquid dispensing machine for liquid retained in a plurality of removable and replaceable containers, said liquid dispensing machine comprising;

a cabinet;

a suitably selected holder housed in the cabinet, for releasably retaining the plurality of containers;

a furcated passage comprising a main passage, an open end to define an outlet and a plurality of branches, each terminating in an inlet, said furcated passage to permit fluid communication between the plurality of containers and said outlet;

said outlet being in communication with the ambient atmosphere, said outlet located to permit feeding of the liquid from the containers to said outlet;

a plurality of terminally located liquid dispensing systems for releasably coupling said inlet to a container to permit the flow of liquid;

a dispensing valve to stop and start the flow of liquid;

a controller to determine the flow of liquid through said furcated passage and to selectively actuate said dispensing valve, wherein the branches of the furcated passage are in series, such that in use, one container is substantially drained before the next container begins to drain; and a currency acceptor and processor for communication with said controller, wherein liquid is dispensed from said currency operated liquid dispensing machine in a metered volume in response to input of a selected value of currency.

* * * * *